United States Patent [19]

Sauer

[11] Patent Number: 4,584,942

[45] Date of Patent: Apr. 29, 1986

[54] DEVICE FOR FASTENING ONE EXTREMITY OF A SOFT AND FOLDINGPROOF BLANKET ON A CYLINDER OF A ROTARY PRINTING MACHINE

[75] Inventor: Hartmut K. Sauer, Himmelstadt, Fed. Rep. of Germany

[73] Assignee: De La Rue Giori SA, Lausanne, Switzerland

[21] Appl. No.: 568,364

[22] Filed: Jan. 5, 1984

[30] Foreign Application Priority Data

Jan. 18, 1983 [CH] Switzerland ..... 258/83

[51] Int. Cl.[4] ..... B41F 1/28

[52] U.S. Cl. ..... 101/415.1

[58] Field of Search ..... 101/415.1; 51/364, 368, 51/369

[56] References Cited

U.S. PATENT DOCUMENTS

| | | | |
|---|---|---|---|
| 2,209,127 | 7/1940 | Lowe | 101/415.1 |
| 2,285,116 | 6/1942 | Grupe | 101/415.1 X |
| 2,850,970 | 9/1958 | Brodie | 101/415.1 |
| 2,986,085 | 5/1961 | Johnson | 101/415.1 X |
| 3,844,214 | 10/1974 | Smith | 101/415.1 |

FOREIGN PATENT DOCUMENTS

| | | | |
|---|---|---|---|
| 1213861 | 4/1966 | Fed. Rep. of Germany | 101/415.1 |
| 170309 | 2/1960 | Sweden | 101/415.1 |

*Primary Examiner*—Edgar S. Burr
*Assistant Examiner*—Moshe I. Cohen
*Attorney, Agent, or Firm*—Birch, Stewart, Kolasch & Birch

[57] ABSTRACT

The cylinder is provided with a radial insertion slot forming in its inner portion a widened cavity. One of the walls of the slot is provided with a receiving groove of which the median plane forms with the wall of the slot an acute angle of the order of 30°. The folded end reinforced by a spring-steel blade of the blanket is inserted into the slot and thrusted by using a thin piece of sheet-metal or a spatula until, due to the return force of the blanket, it engages the opening of the groove. Then, the blanket is pulled outwards so that the reinforced end penetrates into the groove. Subsequently, the second end of the blanket is attached in the known fashion to a stretching pivot. The length, in the peripheral direction, of the bottom of the widened cavity is greater than the width of the folded end of the blanket, and the width of the outer portion of the radial slot is smaller than the width of the folded end.

5 Claims, 3 Drawing Figures

DEVICE FOR FASTENING ONE EXTREMITY OF A SOFT AND FOLDINGPROOF BLANKET ON A CYLINDER OF A ROTARY PRINTING MACHINE

BACKGROUND OF THE INVENTION

1. Field of the Invention

The present invention relates to a device for attaching one end of a sheet of flexible material, such as a blanket, on a cylinder of a rotary printing machine, the cylinder being provided with a radial insertion slot extending parallel to the cylinder axis, for attaching the folded end of the sheet.

2. Description of the Prior Art

Such a device is depicted in the German patent DE No. 22 52 949. The wall of the insertion slot is provided with a device for attaching one of the sheet ends. The attachment device is provided with a bevelled edge, inserted in the cylinder body. An edge fixing strip secured to the end of the sheet is slipped into this bevelled edge. To prevent the strip from falling outside, this strip must be protected by a safety device, thus making the fixing of the sheet end more complicate.

SUMMARY OF THE INVENTION

The object of this invention is to avoid these drawbacks by providing a device permitting of fixing and fastening in a simple way the end of a flexible, foldproof sheet on the cylinder body.

The attachment device according to the invention is characterized by the fact that the radial slot in its inner portion constitutes a cavity of which the cross section widens out towards the cylinder axis and of which the inner bottom has, in the peripheral direction, a greater width that the folded portion of the sheet end, that one of the walls of the radial slot is provided with a receiving groove parallel to the cylinder axis and forming an acute angle with the portion of said wall which extends outwards and that the maximum width of the outer portion of the radial slot which extends beyond the receiving groove is smaller than the width of the folded portion of the sheet end.

The advantages resulting from this device derive mainly from its simplicity which permits attaching one end of a flexible, fold-proof sheet, for example a blanket, on the body of a cylinder without resorting to an additional device for preventing the attached ends from loosening unintentionally, for example by gravity or under the influence of centrifugal force. The sheet end to be attached is folded and preferably reinforced by means of a steel blade for stiffening it, this end being pushed into the insertion slot with its folded edge first, and the folded portion is pushed against the wall provided with the receiving groove. As a consequence of the folding resistance of the sheet the folded end acts like a spring which expands when its free end registers with the receiving groove, whereafter the sheet is no more pushed but slightly pulled outside the slot so that the complete folded portion engages the groove. To release the end attached in the groove the sheet is pushed as before into the slot until the folded portion is extracted from the groove and lies in the widened out recess in which the end is unfolded completely so that the slot engaging portion can be removed.

The slot walls may be parallel to the median plane of the slot which is at the same time a radial plane of the cylinder. Thus, and owing to the slight weakening of the cylinder body due to the longitudinal supporting key, one may also use the cylinder in printing machines, for example in rotary direct plate printing machines in which the cylinders are exposed to a particularly high line load. The blankets covering the impression cylinders of these machines consist of canvas or linen fabric lined with an external layer of rubber. The total thickness of a blanket of this type is of the order of 0.4 to 0.7 mm.

BRIEF DESCRIPTION OF THE DRAWINGS

The invention will now be described more in detail with the assistance of the attached drawing illustrating one form of embodiment thereof.

DESCRIPTION OF THE PREFERRED EMBODIMENT

Figure 2:
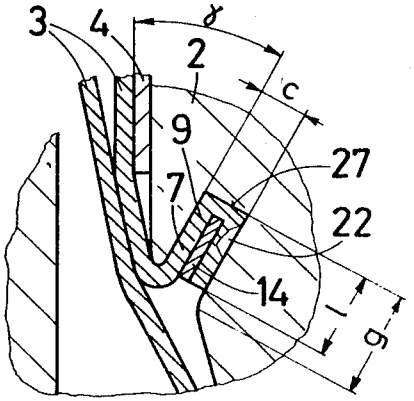
FIG. 2 illustrates a detail of FIG. 1 on a larger scale.

The sheet 3 to be attached to the jacket 1 of the cylinder 2 of a printing machine is a blanket having a thickness of about 0.5 mm. The cylinder 2 is provided with an insertion slot 6 opening on the jacket 1 so that one or both of the ends 7,8 of blanket 3 can be brought to an attachment device 9,11.

Figure 3:
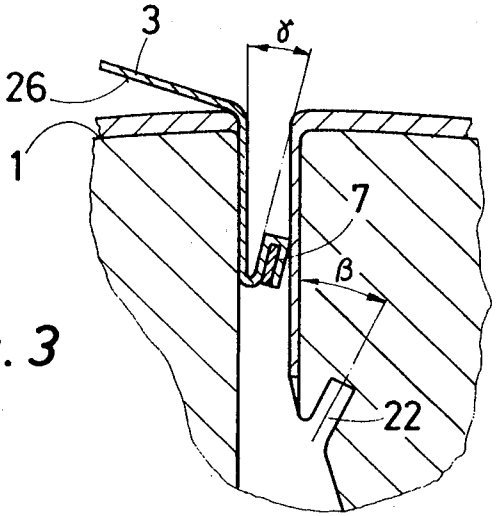
FIG. 3 illustrates a view similar to that of FIG. 1, with the sheet end still unattached.
Figure 1:
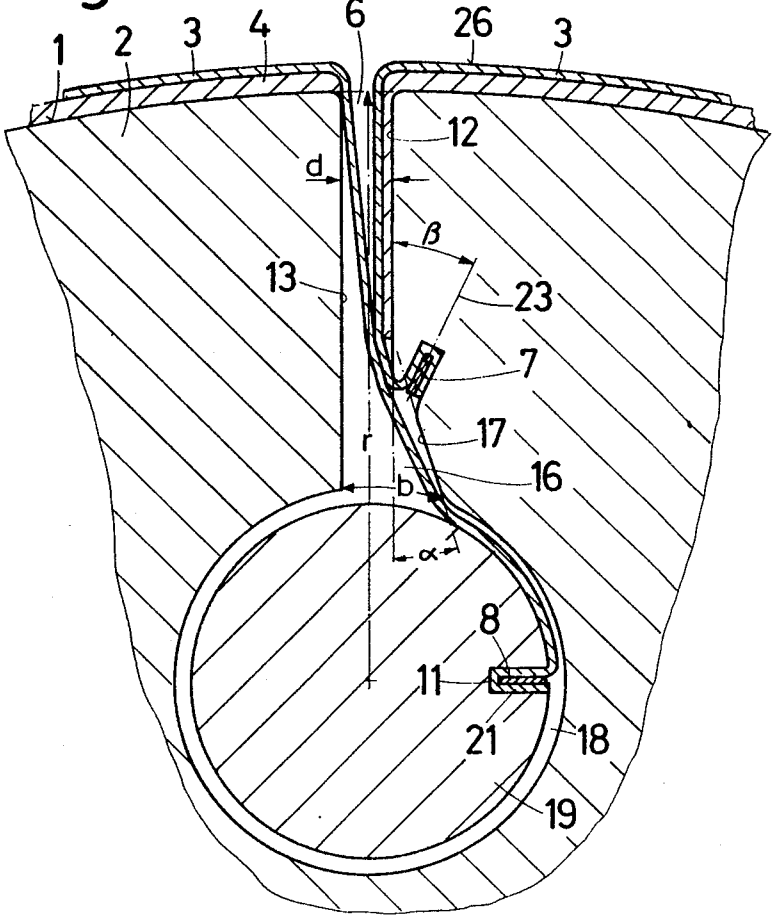
FIG. 1 illustrates a fragmentary cross-sectional view of an attachment device showing the end of the attached sheet.

The insertion slot 6 has preferably two walls parallel to each other and to the median plane of slot 6 denoted by the line r which is simultaneously a radial plane of the cylinder. The width d of this slot 6 is about 4 mm. The width of insertion slot 6 is sufficient to permit the slipping and pushing into it of the folded and reinforced end 7 of blanket 3 towards the cylinder, this reinforcement consisting of a spring steel blade 14 for example 0.2-mm thick and 5-mm wide, bonded to the folded end of blanket 3. The angle $\gamma$ between the end 7 and blanket 3 should be only a few degrees (5° to 15°) when inserting the folded end 7 into the insertion slot 6 (FIG. 3). The radial slot 6 provides at its lower portion a cavity 16 parallel to the axis of cylinder 2, which cavity has a cross section widening out inwardly. The cavity 16 is bound by an inclined portion 17 of wall 12 and the second wall 13 of slot 6. The acute angle $\alpha$ between the outer portion of wall 12 and the inclined portion is of the order of 20°.

The widened cavity 16 opens for instance into a cylindrical hole 18 for a stretching pivot, which hole is coaxial with the cylinder, and where the stretching pivot 19 is set. The stretching pivot 19 is provided with a groove 21 parallel to the axis of cylinder 2 and adapted to retain the second reinforced end 8 of blanket 3.

Inserted in wall 17, at the beginning of cavity 16, is a groove 22 parallel to the cylinder axis, which extends throughout the length of cylinder 2 and has a rectangular contour. The median plane 23 of the groove forms with wall 12 an angle $\beta$ within the range of 5° to 45°, preferably 30°. The width c of groove 22 is so selected that just enough room is left for the reinforced end 7 of blanket 3. The depth g of the receiving groove 22 is slightly greater that the length l of the first reinforced end 7 of blanket 3.

The procedure for attaching the end 7 of the blanket is as follows:

The blanket 3 is folded at its first end 7, just behind the spring steel strip 14, so as to engage the side of the insertion slot 6 in which the receiving groove 22 (FIG. 3) is formed. Thus, the blanket 3 rests in such a way that its outer side 26 engages the jacket 1 of cylinder 2. Then, the folded end 7, in this folded condition, is inserted, from the jacket 1, into the insertion slot 6, with the assistance of a thin sheet-metal element or a spatula. It is well to assist a proper insertion by pushing several times the bent end along the insertion fissure 6. Since, when folding the end, the length l of the folded end 7 was selected so as to be only slightly greater than the width d of the insertion slot 6, the folded end 7, when slipping into the insertion slot 6, can open only very slightly. But when the end 7, or more accurately stated, its front portion 27 is level with the opening in the receiving groove 22, the opening angle $\gamma$ of the folded end 7 increases due to the action exerted by the blanket 3 and the front portion 27 will slip into the receiving groove 22. If under these conditions the now gripped blanket 3 is pulled towards the cylinder circumference, the first end 7 will penetrate into the longitudinal groove 22 up to the level of the folding edge of blanket 3. Then the blanket 3 is folded back and its second end 8 is introduced into the groove 21 of stretching pivot 19, by passing through the insertion slot 6. By rotating the stretching pivot 19, the blanket 3 is stretched, in the known fashion.

To remove the blanket 3, the second end 8 is extracted firstly from the stretching pivot 19, in the known manner, and then from the insertion slot 6. Then the blanket 3 on the jacket 1 of cylinder 2 is slackened sufficiently to permit the thrusting of the blanket 3 into the insertion slot 6, on the side of its still gripped end 7. By exerting a thrust, this end 7 is released completely from the receiving groove 22 in which the end 7 was still gripped. After this release, the end 7 opens as a consequence of the inner return force of the resilient blanket 3. This phenomenon is made possible because the magnitude b of the bottom of cavity 16 is greater than the length l of the folded portion of the first end 7 of blanket 3. Thus, the end 7 of blanket 3 can be extracted completely from the receiving groove 22.

Of course, the blanket 3 may rest on a lining 4.

The great advantage of this attachment procedure for the ends of a blanket lies in its utilization on cylinders which must have a small slot and cylinders subjected to considerable forces. This case arises for example with impression cylinders on web fed rotary machines for direct or steel plate printing.

Of course, the attachment device may also be used for other applications, for example for fixing blankets on a blanket cylinder of an offset printing machine, provided that the blanket thickness is not excessive so that it can be folded. As a rule, blanket having a thickness of 0.4 to 0.7 mm can be attached to the cylinder by means of the above-described device.

What is claimed is:

1. In combination, cylinder of a rotary printing machine and a flexible shaft mounted on said cylinder, said sheet having a folded end having a length 1, means for attaching one end of said sheet said radial slot out towards said axis of said cylinder to form a cavity which has, in the peripheral direction, a width greater than the length l of said folded end of said sheet, the distance between the walls of said cavity being greater than the distance between said insertion walls of said slot, one of said walls of said radial slot being provided with a longitudinal groove parallel to said axis of said cylinder for fastening said folded end of said sheet, the median plane of said walls of said radial slot located radially outwardly of said cavity being parallel to said inclined portion being divergent in relation with the other said cavity wall towards said cylinder axis, said longitudinal groove having a substantially rectangular cross-section and forming an acute angle with the portion of said wall extending outwards, said longitudinal groove located on said inclined portion of said cavity, the maximum distance between said walls of said cavity which extend outward beyond said longitudinal groove being smaller than the length 1 of said folded end of said sheet and the maximum distance between said walls of said cavity is greater than the length 1 of said folded end of said sheet.

2. Attachment device according to claim 1, wherein said folded end of said sheet is provided with a spring-steel blade.

3. Attachment device according to claim 1, wherein at least one of said walls of said radial slot is parallel to said radial plane of said cylinder.

4. Attachment device according to claim 1, wherein the said acute angle formed between said longitudinal receiving groove and said wall of said radial slot ranges from 5° and 45° and is preferably equal to 30°.

5. Attachment device according to claim 1, wherein said acute angle formed by the plane of the external portion of the wall provided with said receiving groove and the plane of said inclined portion is about 20°.

* * * * *